US005655582A

United States Patent [19]

Morin

[11] Patent Number: 5,655,582

[45] Date of Patent: Aug. 12, 1997

[54] MODIFIED QUICK CHANGE INSERTED EDGES ANVIL SYSTEM FOR WOOD CHIPPERS

[75] Inventor: Gilles Morin, 1335 Guyon, Charlesbourg, Quebec, Canada

[73] Assignee: Gilles Morin, Quebec, Canada

[21] Appl. No.: 589,267

[22] Filed: Jan. 22, 1996

[30] Foreign Application Priority Data

Apr. 4, 1995 [CA] Canada ..... 2146295

[51] Int. Cl.[6] ..... B27C 7/00; B27G 13/00

[52] U.S. Cl. ..... 144/176; 144/330; 144/373; 144/162.1; 241/286; 241/291; 241/296; 29/402.13

[58] Field of Search ..... 241/86, 88.1, 191, 241/197, 198, 92, 286, 291, 296, 298, 300; 144/162.1, 172, 174, 176, 330, 373

[56] References Cited

U.S. PATENT DOCUMENTS

| | | | |
|---|---|---|---|
| 4,059,884 | 11/1977 | Weil | 144/162.1 |
| 4,187,891 | 2/1980 | Weil | 144/162.1 |
| 4,218,024 | 8/1980 | Pallmann | 241/286 |
| 4,771,718 | 9/1988 | Carpenter | 144/176 |
| 4,850,408 | 7/1989 | Carpenter | 144/241 |
| 4,875,631 | 10/1989 | Bardus | 241/92 |
| 4,997,018 | 3/1991 | Carpenter | 144/241 |
| 5,146,963 | 9/1992 | Carpenter | 144/231 |

FOREIGN PATENT DOCUMENTS 2051233 1/1996 Canada .

*Primary Examiner*—W. Donald Bray
*Attorney, Agent, or Firm*—Baker & Daniels

[57] ABSTRACT

An anvil for a wood chipper includes an anvil body having a top surface, a bottom surface, and longitudinally extending side surfaces between the top and bottom surfaces. At least one of the side surfaces is adapted to accept an insert shaped and dimensioned to fit into the adapted side surface of the body. Means within the body for firmly holding the insert in contact with the adapted side surface are also provided. The insert presents a leading edge functioning as the anvil's leading edge.

12 Claims, 3 Drawing Sheets

MODIFIED QUICK CHANGE INSERTED EDGES ANVIL SYSTEM FOR WOOD CHIPPERS

FIELD OF THE INVENTION

The present invention relates to the field of wood chipping equipment. In particular the present invention provides an improved anvil system for a chipper.

BACKGROUND OF THE INVENTION

A chipper, or chipping machine, can be considered as consisting of three essential pieces or parts within a robust, rigid framework. A spout serves to guide debarked logs that are to be formed into wood chips for subsequent pulpmaking into a knife radially mounted on a rotating disk, which slices through the wood at the angle of the spout. As the knife bears against the log, the opposite surface of the log is pressed against an anvil. The knife acts as a wedge, creating a shearing force in the grain of the wood. As the shearing force builds to a critical point, the stress parallel to the grain of the wood causes chips to be formed, as will be illustrated herein.

The anvil, together with the spout, is intended to carry the piece at the correct location and orientation for the chip forming action of the knives and disk. Wear of the infeed spout causes misalignment of solid wood at the anvil/knife contact point, producing inconsistent chip size. The anvil edge needs to be sharp. If the knives and the anvil act together in a close scissor-like configuration, the log or piece can "ride easy" in the spout. Otherwise, especially if the log or piece is short or small in cross section, it can be tipped or thrown out of its correct position, resulting in bad chips. Dull knives aggravate this effect.

It will be understood then, that it is necessary to maintain the anvil of a chipper in prime condition, if efficient operation of the chipper is desired. To this end, the American Pulpwood Association recommends servicing the anvil of a chipper once a week. Servicing of an anvil will entail replacement, renewal (i.e., edge grinding, if enough stock remains) or turning, if an unworn edge of the anvil is available. It will be appreciated that replacement of an anvil, which is a heavy piece of very high grade tooled steel can be quite expensive, and renewal of anvils edges, while less expensive in material consumption, requires a machine to be shut down while the edge is reground by a skilled wright. Turning an anvil is a temporary solution only, since an anvil provide four edges at most. Moreover, to be turned, the anvil must be completely removed from its mounting.

SUMMARY OF THE INVENTION

An object of the present invention is to provide an anvil for use with a wood chipper that is easy to service.

A further object of the present invention is to provide an anvil for use with a wood chipper that may be serviced, and the edges thereof turned, without the need to remove the anvil from its mounting on the chipper.

A further object of the present invention is to provide an anvil for a wood chipper that is provided with a leading edge incorporating a removal and replaceable insert that can be serviced and/or replaced without having to replace the entire anvil.

In one broad aspect, the present invention relates to an anvil for a wood chipper including: (i) an anvil body having a top surface, a bottom surface, and longitudinally extending side surfaces between the top and bottom surfaces, at least one of said side surfaces being adapted to accept an insert; (ii) an insert shaped and dimensioned to fit into said adapted side surface of said body; and (iii) means within said body for firmly holding said insert in contact with said adapted side surface; said insert presenting a leading edge functioning as the anvil's leading edge.

In another broad aspect, then, the present invention relates to an anvil for a wood chipper including: an anvil body having a top surface, a bottom surface, and longitudinally extending side surfaces between the top and bottom surfaces, at least one of said side surfaces being channelled with a V-shaped groove and having a substantially circular slot inwardly of the V-shaped groove; an insert shaped and dimensioned to fit into said V-shaped groove and circular slot in said side surface of said body; and means within said body for firmly holding said insert in contact with said V-shaped groove and circular slot in said side surface; said insert presenting a leading edge functioning as the anvil's leading edge.

In a further aspect of the present invention, there is provided an anvil for a wood chipper including: an anvil body having a top surface, a bottom surface, longitudinally extending side surfaces between the top and bottom surfaces, at least one of said side surfaces being adapted to accept an insert; a narrow slot extending into said anvil body inward of said insert a sufficient distance to permit the sides of said anvil body to be deflected inwardly upon clamping pressure being exerted against the top and/or bottom surface of said anvil body; and a bore in said anvil body perpendicular to and extending through said narrow slot; an insert shaped and dimensioned to fit into said adapted side surface of said body; and means engageable with said bore to cause the sides of said anvil to be deflected inwardly and thereby maintain said insert firmly in said groove; said insert presenting a leading edge functioning as the anvil's leading edge.

BRIEF DESCRIPTION OF THE DRAWINGS

In drawings that illustrate the present invention by way of example.

DETAILED DESCRIPTION

Figure 1:
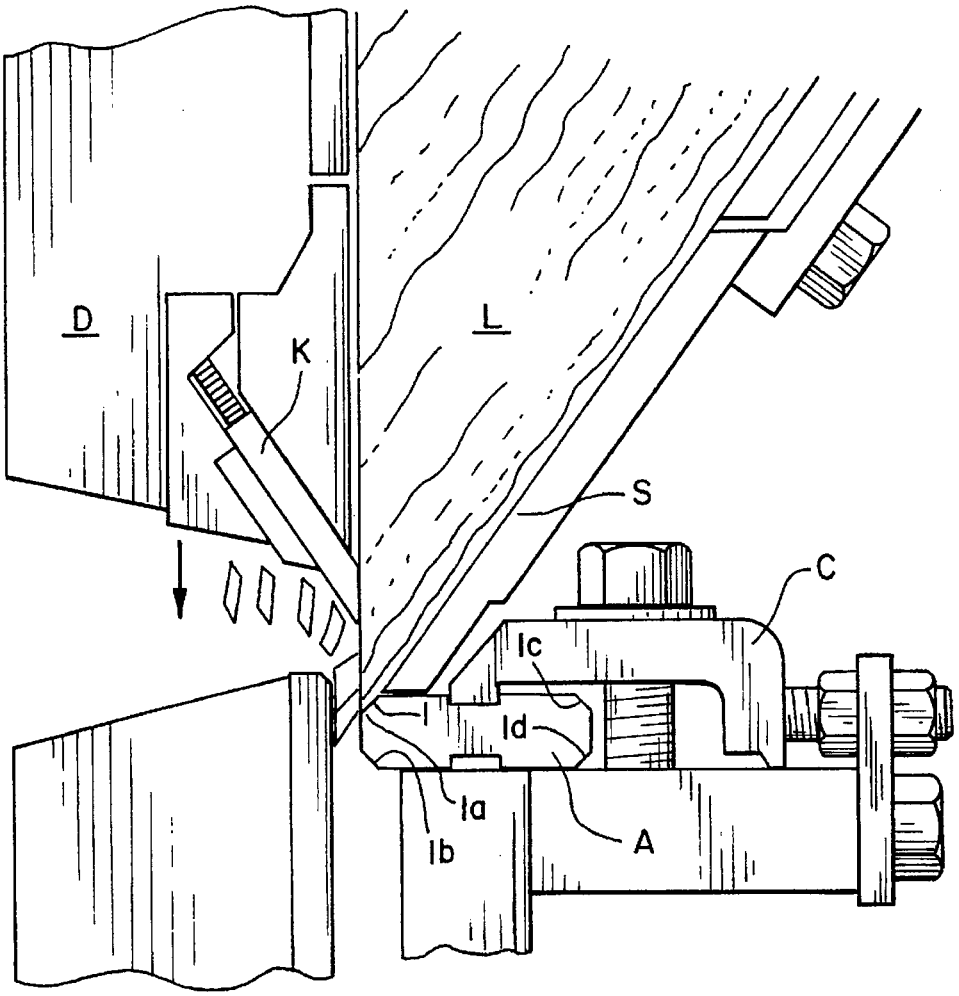
FIG. 1 is a side view of a generalized form of diagonal or drop feed chipper showing an anvil according to the prior art, in unworn condition.
Figure 2:
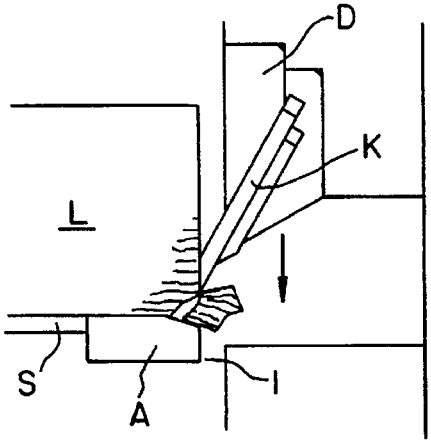
FIG. 2 is a side view of a generalized form of horizontal feed chipper showing an anvil according to the prior art, in worn condition.

Referring first to FIGS. 1 and 2, it will be observed that the anvil A is mounted on the lowermost edge of spout 5 through which a log L is fed. A knife K is mounted on a disk D that rotates, causing the knife K to shear chips from the log L. It will be observed that the forward edges 1 of the anvil A may be either bevelled, or squared, depending on the angle of the spout. In either case, it is essential that the knife blade pass by the edge of the anvil with an extremely close tolerance. Moreover, the leading edge of the anvil must be quite sharp, or, as is illustrated in FIG. 2, it will not correctly support the lower surface of the log against the pressure of the knife, causing poorly formed chips to be cut.

As the leading edge of the anvil assumes the worn condition shown in generalized form in FIG. 2, the anvil must be serviced. It can be turned over, and flipped end to end, until each of its maximum of four edges 1*a*, 1*b*, 1*c* and 1*d* is worn out. Then it is removed for regrinding at each edge, a labour intensive process. If each edge has been ground beyond specified tolerances, the anvil must be replaced.

Figure 3:
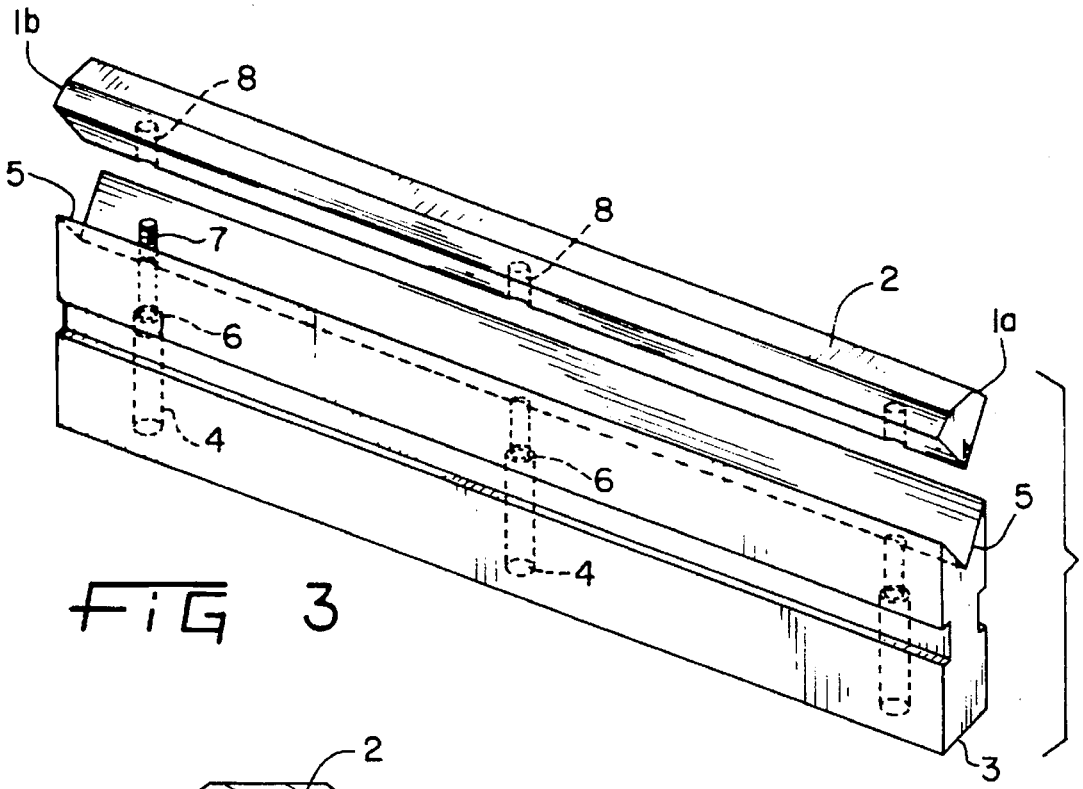
FIG. 3 is a perspective view of a first embodiment of the present invention.

Referring to FIG. 3, the present invention provides an anvil having a removable edge insert 2 with two leading edges 1*a* and 1*b*. When these edges become worn, it is not necessary to remove the entire anvil for servicing. Rather, the anvil is merely loosened from its clamp mount C (see FIG. 1) and the insert 2 is removed therefrom by loosening two or more bolts accessible from the opposite side 3 of the anvil. In this regard, the anvil of FIG. 3 is provided with two or more, for instance three, lateral bores 4 extending from and centred just beneath the insert, in a V-shaped (as illustrated) or squared channel 5, to the opposite side of the anvil. Each bore 4 is provided with a shoulder 6 against which the head of a threaded bolt 7 may bear, the bolt threading into a tapped bore 8 in the insert 2 that is aligned with the bore 4 in the anvil. The head of the bolt 7 is tooled to accept an allen key, or any other suitable turning tool.

Utilizing the anvil system shown in FIG. 3, the edge insert 2 of the anvil may be reversed to present the lower edge thereof, or it may be replaced, as required, in a minimum of time. Since the edge insert will be much less expensive than an entire anvil, after it has worn out from repeated grinding, it can be replaced at much less cost than an entire anvil.

Figure 4:
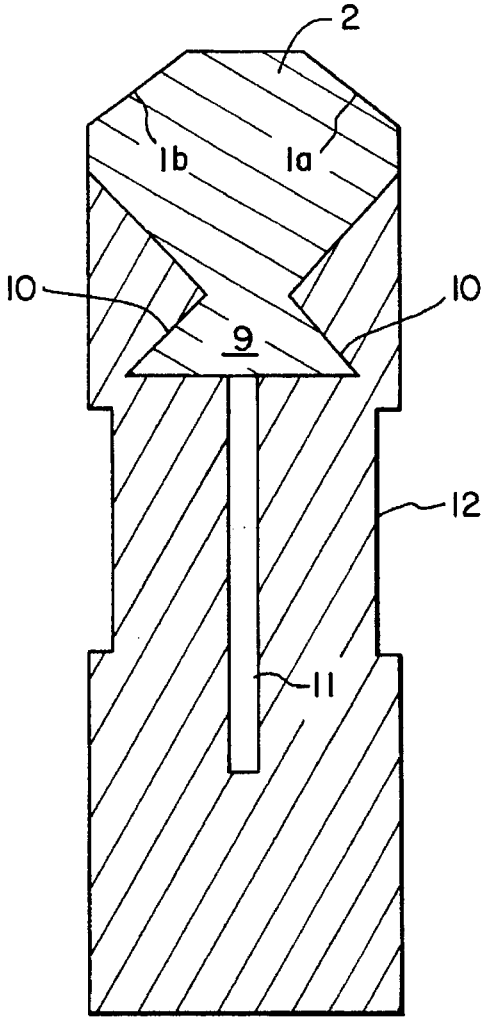
FIG. 4 is an end view of a second embodiment of the present invention.

Another embodiment of the present invention is shown in FIG. 4. In FIG. 4, the edge insert 2 is provided with a dovetail fitting 9 along its inner edge, dimensioned and conformed to fit, like a key into a lock, into a corresponding dovetail slot 10 in the body of the anvil. A longitudinal slot 11 extends into the body of the anvil from the centre of the dovetail slot 10. Servicing of the anvil of FIG. 4 is very efficient, requiring only that the clamp C holding the anvil in place be loosened. Loosening the clamp, which fits into one of the longitudinal side channel 12 on the anvil, above the longitudinal slot 12 removes pressure exerted on the insert and holding it in place. The clamp is able to put pressure on the insert because the sides of the anvil will tend to deflect inwardly under pressure of the clamp, pressing the sides of the slot 11 together, when the clamp is tightened. This causes the dovetail slot 10 to constrict, and firmly clamp the dovetail fitting 9. Accordingly, it will be understood that the anvil of FIG. 4, to be serviced, need not be removed from the chipper. The clamp holding the anvil is loosened, and the insert is slid out of the anvil, and reversed or replaced. The clamp is then tightened.

Figure 5:
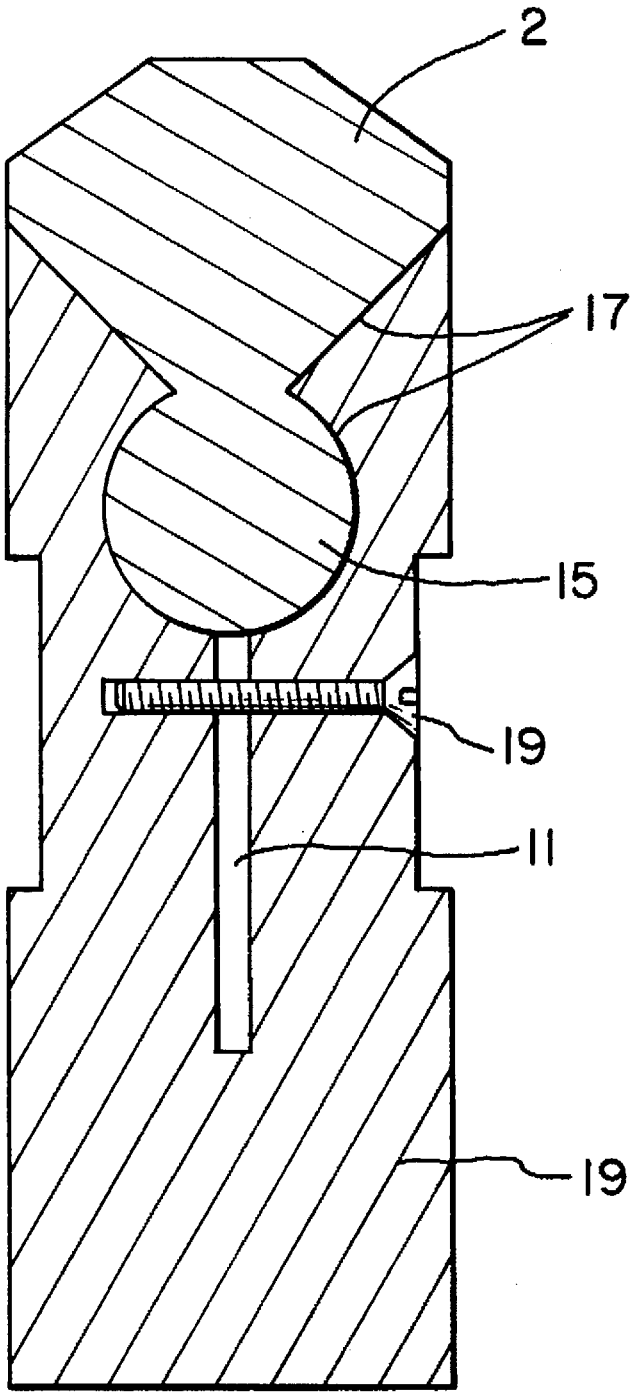
FIG. 5 is an end view of a third embodiment of the present invention.

A further preferred embodiment of the present invention is shown in FIG. 5. In FIG. 5, the edge insert 2 is provided with a modified retainer fitting 15 along its inner edge, dimensioned and conformed to fit into a corresponding insert keyway slot 17 in the body of the anvil. The inside edge of the fitting of the edge insert 2 is generally circular in end view, being shaped like a partial cylinder.

As in the embodiment illustrated in FIG. 4, a longitudinal slot 11 extends into the body of the anvil from the centre of the insert slot 17. Into the side of the anvil and through the longitudinal slot is threaded a set screw 19 which is tightened to aid the clamp C in the retention of the edge insert 2 in the anvil. Loosening the clamp C and the set screw 19 removes the pressure exerted on the insert 2 and allows it to be removed from the anvil for replacement or service. Tightening the set screw 19 and the clamp C exerts pressure on the insert 2 thereby holding it firmly in place.

It is to be understood that the examples described above are not meant to limit the scope of the present invention. It is expected that numerous variants will be obvious to the person skilled in the field to which the present invention pertains without any departure from the spirit of the invention. The appended claims, properly construed, form the only limitation upon the scope of the invention.

I claim:

1. An anvil for a wood chipper including:

i) an anvil body having a top surface, a bottom surface, and longitudinally extending side surfaces between the top and bottom surfaces, at least one of said side surfaces being adapted to accept an insert;

ii) an insert shaped and dimensioned to fit into said adapted side surface of said body; and iii) means within said body for firmly holding said insert in contact with said adapted side surface;

said insert presenting a leading edge functioning as the anvil's leading edge.

2. An anvil for a wood chipper as described in claim 1, wherein said adapted side surface of said body is channelled with a V-shaped channel.

3. An anvil for a wood chipper as claimed in claim 2, wherein bores extend through said body from the inner surface of said V-shaped groove to the opposite side surface of said anvil, and threaded bolt means are provided, engageable with tapped bores in said insert, to maintain said insert firmly in said channel.

4. An anvil for a wood chipper as claimed in claim 2, wherein said body is provided with a dovetail slot inwardly of the V-shaped groove, and said insert is provided with a dovetail fitting along its length, whereby said insert may be slid into said dovetail slot lengthwise.

5. An anvil for a wood chipper as claimed in claim 4, wherein a further, narrow slot extends inward of said dovetail slot a sufficient distance to permit the sides of said anvil to be deflected inwardly upon clamping pressure being exerted against the top and/or bottom surface of said anvil.

6. An anvil for a wood chipper including:

i) an anvil body having a top surface, a bottom surface, and longitudinally extending side surfaces between the top and bottom surfaces, at least one of said side surfaces being channelled with a V-shaped groove and having a substantially circular slot inwardly of the V-shaped groove;

ii) an insert shaped and dimensioned to fit into said V-shaped groove and circular slot in said side surface of said body; and iii) means within said body for firmly holding said insert in contact with said V-shaped groove and circular slot in said side surface;

said insert presenting a leading edge functioning as the anvil's leading edge.

7. An anvil for a wood chipper as described in claim 6 wherein said bores extend through said body from the inner surface of said V-shaped groove to the opposite side surface of said anvil body, and threaded bolt means are provided, engageable with tapped bores in said insert, to maintain said insert firmly in said groove.

8. An anvil for a wood chipper as claimed in claim 7 wherein a further, narrow slot extends inward of said substantially circular slot a sufficient distance to permit the sides of said anvil body to be deflected inwardly upon clamping pressure being exerted against the top and/or bottom surface of said anvil body.

9. An anvil for a wood chipper as claimed in claim 8 wherein a bore is provided in said anvil body perpendicular to and extending through said narrow slot inward of said circular slot and a threaded bolt means is provided engageable with said bore in said anvil body to cause the sides of said anvil body to be deflected inwardly and thereby maintain said insert firmly in said groove.

10. An anvil for a wood chipper as claimed in claim 9 wherein said threaded bolt means is a set screw.

11. An anvil for a wood chipper including:

i) an anvil body having a top surface, a bottom surface, longitudinally extending side surfaces between the top and bottom surfaces, at least one of said side surfaces being adapted to accept an insert; a narrow slot extending into said anvil body inward of said insert a sufficient distance to permit the sides of said anvil body to be deflected inwardly upon clamping pressure being exerted against the top and/or bottom surface of said anvil body; and a bore in said anvil body perpendicular to and extending through said narrow slot;

ii) an insert shaped and dimensioned to fit into said adapted side surface of said body; and iii) means engageable with said bore to cause the sides of said anvil to be deflected inwardly and thereby maintain said insert firmly in said groove;

said insert presenting a leading edge functioning as the anvil's leading edge.

12. An anvil for a wood chipper as claimed in claim 11 wherein said means engageable within said bore is a threaded screw.

* * * * *

UNITED STATES PATENT AND TRADEMARK OFFICE

CERTIFICATE OF CORRECTION

PATENT NO. : 5,655,582

DATED : August 12, 1997

INVENTOR(S) : Gilles Morin

It is certified that error appears in the above-identified patent and that said Letters Patent is hereby corrected as shown below:

Claim 7, Col. 4, Line 57, before "bores" insert --means for holding comprises--.
Claim 7, Col. 4, Line 57, before "extend" insert --which--.

Signed and Sealed this

Nineteenth Day of May, 1998

Bruce Lehman

*Attest:*

BRUCE LEHMAN

*Attesting Officer*

*Commissioner of Patents and Trademarks*